US006029815A

United States Patent [19]

Ali

[11] Patent Number: 6,029,815

[45] Date of Patent: Feb. 29, 2000

[54] PACKAGING SUBSTRATE CONFIGURED FOR CONNECTION TO A ROTARY CUTTING WHEEL

[76] Inventor: Terry Ali, 611 Yellow Springs-Fairfield Rd., Fairborn, Ohio 45324

[21] Appl. No.: 09/131,965

[22] Filed: Aug. 11, 1998

[51] Int. Cl.[7] ..... A45C 11/26

[52] U.S. Cl. ..... 206/349; 206/460; 206/303

[58] Field of Search ..... 206/349, 461, 206/467, 469, 460, 308.1, 303

[56] References Cited

U.S. PATENT DOCUMENTS

| | | | |
|---|---|---|---|
| 2,950,004 | 8/1960 | Acomb | 206/349 |
| 3,476,239 | 11/1969 | Jacob | 206/461 |
| 4,166,535 | 9/1979 | Gilling | 206/469 |
| 4,168,002 | 9/1979 | Crosby | 206/461 |
| 5,085,318 | 2/1992 | Leverick | 206/308.1 |
| 5,456,057 | 10/1995 | Bannon et al. | 206/349 |
| 5,649,621 | 7/1997 | Brody | 206/349 |
| 5,819,931 | 10/1998 | Boucher et al. | 206/349 |
| 5,908,109 | 6/1999 | Muto | 206/460 |

FOREIGN PATENT DOCUMENTS

| | | | |
|---|---|---|---|
| 560374 | 9/1993 | European Pat. Off. | 206/460 |

*Primary Examiner*—David T. Fidei
*Attorney, Agent, or Firm*—R. William Graham

[57] ABSTRACT

A packaging substrate configured for connection to a rotary cutting wheel has a first portion thereof bonded to a side of the rotary cutting wheel and a second portion of the packaging substrate detached from the rotary cutting wheel and extending outwardly from the side of the rotary cutting wheel. The packaging substrate is configured in a manner to permit the first portion and the second portion to be separated from one another in a manner to leave the first portion substantially in tact on the side of the rotary cutting wheel, wherein a line of demarcation defines between the first and second portions. The second portion is preferably configured as a tab having an eyelet surface extending therethrough for enabling hanging of the rotary cutting wheel on a display rack or the like. The packaging substrate has a printable surface formed thereon.

6 Claims, 2 Drawing Sheets

PACKAGING SUBSTRATE CONFIGURED FOR CONNECTION TO A ROTARY CUTTING WHEEL

BACKGROUND OF THE INVENTION

1. Field of the Invention

The present invention relates generally to the field of packaging. More particularly, the present invention relates to a packaging substrate configured for connection to rotary cutting and grinding wheels.

2. Related Art

Rotary cutting wheels are marketed through one of a retail or bulk mode. Retail commonly results in the rotary cutting wheel being sold as a single item purchase whereas bulk sales results in multiples of the item being purchased at one time. The existing packaging varies greatly for each type of mode. Both modes require numerous warning messages attached to and accompanying the cutting.

Bulk sale packaging can include such warnings on the box and/or literature with which the bulk is sold and in some cases requires the bonding of labels to both sides of the wheel in order to affix the required warnings. Retail packaging additionally requires individual packaging wherein the rotary cutting wheel is packaged adjacent a card bearing such warnings and shrink wrapped together as one unit such that the card and associated wheel may be hung from a display rack. Other costly retail packaging has been used to contain cutting wheels, such as clam shell and blister packages.

A type of cuttings wheels is an abrasive grinding wheel, which is one of two types commonly known in the trade, a type 1 or flat wheel and type 27or raised hub wheel. The rough, porous and uneven surfaces of abrasive wheels, as opposed to steel blades, necessarily require the use of a paper blotter or blotters adhesively bonded about the hub of the wheel which are used to display at least some of the warning, identification, UPC bar code, and operating information. The amount of the information which can be printed on the blotter is limited since the blotter cannot interfere with the configuration and use of the cutting wheel. This limitation is furthered in type 27 wheels wherein only one side of the wheel may include a blotter, as the face of one side of the cutting wheel is used to cut.

While these warning, identification, UPC bar code and operating information are necessary and required, they add increased expense to the cost of the product in the case of placing double blotters, one on each side of the cutting wheel. There is also added expense and waste in shelf space in that a store supplier of the rotary cutting wheels presently has to stock, shelve and display two different types of packages for the same wheel.

Accordingly, there remains a need to improve the packaging of rotary cutting wheels in order to facilitate the display of required warning messages with minimal expense. There is also a need to reduce the waste in stock, shelf and display space within a store.

BRIEF SUMMARY OF THE INVENTION

It is an object to improve packaging for rotary cutting wheels.

It is another object to maximize shelf space by virtue of utilizing goods which are packaged in a manner to be readily displayed in a retail or bulk mode.

Accordingly, the present invention is directed to a packaging substrate configured for connection to a rotary cutting wheel, particularly of the abrasive cutting wheel type. The packaging substrate has a first portion thereof bonded to a side of the rotary cutting wheel and a second portion of the packaging substrate detached from the rotary cutting wheel and extending outwardly from the side of the rotary cutting wheel. The packaging substrate is configured in a manner to permit the first portion and the second portion to be separated from one another in a manner to leave the first portion substantially in tact on the side of the rotary cutting wheel, wherein a line of demarcation defines between the first and second portions which do not extend beyond a periphery of the rotary cutting wheel. The second portion is preferably configured as a tab having an eyelet surface extending therethrough for enabling hanging of the rotary cutting wheel on a display rack or the like. The packaging substrate has a printable surface formed thereon in order to adequately facilitate printing of the required information.

Other objects and advantages will be readily apparent to those skilled in the art upon viewing the drawings and reading the detailed description hereafter.

DETAILED DESCRIPTION OF THE INVENTION

Figure 1:
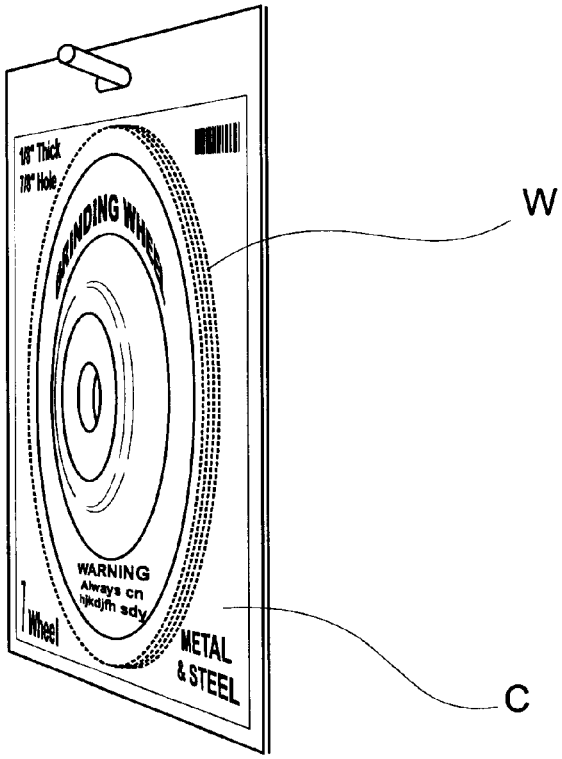
FIG. 1 is a perspective view of a prior art packaging for a rotary cutting wheel.

Referring now to the drawings, the prior art is generally depicted in FIG. 1 and shows a rotary abrasive wheel W shrink wrapped about a card stock C. As seen in FIG. 1, the card C is utilized to display the required warning messages, instructions and sales information, such as the bar code. This packaging is exclusively designed for use in retail mode as single unit sales.

The packaging substrate of the present invention is generally referred to by the numeral 10 and is made of a paper-based material. The packaging substrate 10 configured for connection to a rotary cutting wheel 11. The packaging substrate 10 has as a first portion 12 thereof bonded to a side 14 of the rotary cutting wheel 11 via and an adhesive 16. A second portion 18 of the packaging substrate 10 is detached from the side 14 of the rotary cutting wheel 11 and extends outwardly from the side 14 and beyond the edge 20 of the rotary cutting wheel W.

The packaging substrate 10 has a printable surface 19 formed thereon which extends across the first portion 12 and second portion 18. The printable surface 19 enables the printing of warning, identification, UPC bar code, and operating information and optionally, a manufacturer' coupon.

The packaging substrate 10 is configured in a manner to permit the first portion 12 and the second portion 18 to be separated from one another in a manner to leave the first portion 12 substantially in tact and bonded to the side 14 of the rotary cutting wheel W. A line of demarcation 22, preferably a perforated line, defines between the first portion 12 and second portion 18.

The first portion 12 is generally of an annular shape and of a size which does not extend beyond the edge 20 thus preventing a potential separation from the rotary cutting wheel 11 when in use. In this regard, the line of demarcation 22 is disposed radially inward from the edge 20 and may be curved or straight to accomplish said objective which will in turn affect the geometry of the first portion 12.

Figure 2:
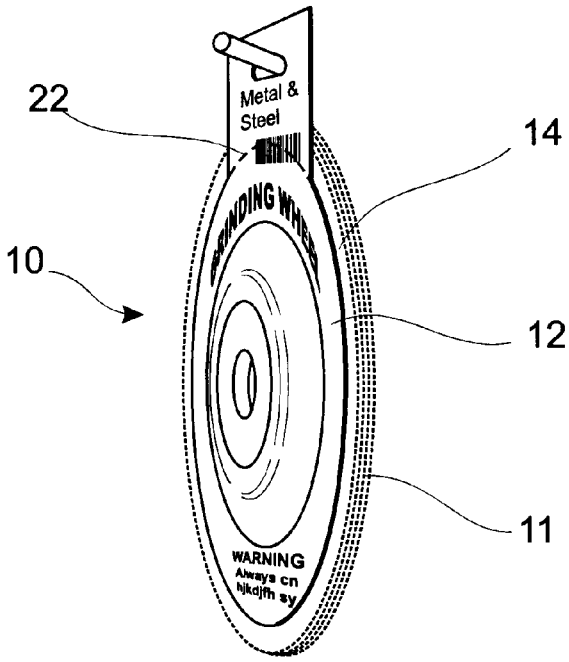
FIG. 2 is a perspective view of the present invention in use on a rotary cutting wheel in a retail display mode.
Figure 3:
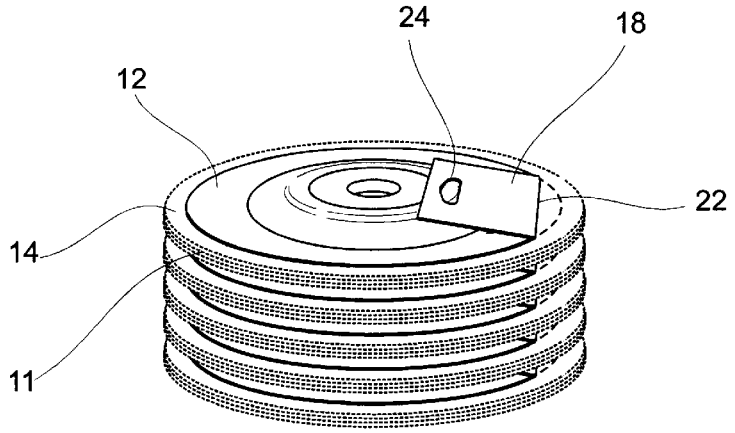
FIG. 3 is a perspective view of the present invention in use on a rotary cutting wheel in a bulk display mode.
Figure 4:
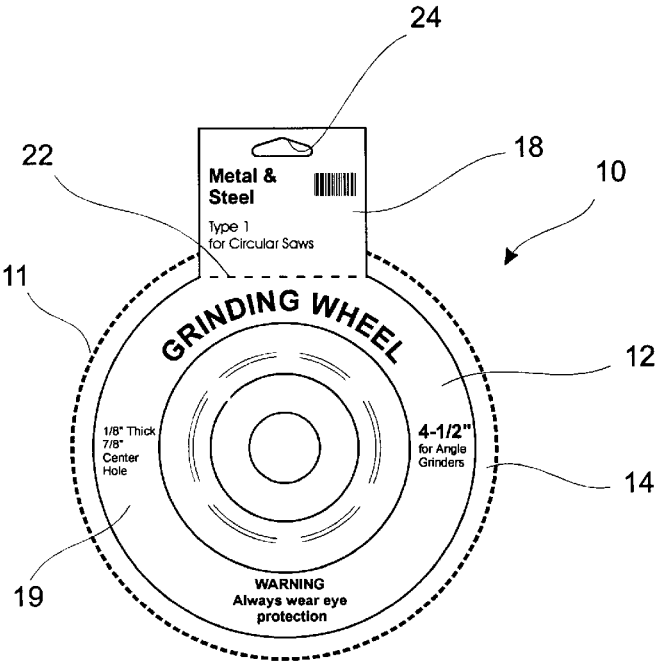
FIG. 4 is a plan view of the present invention.
Figure 5:
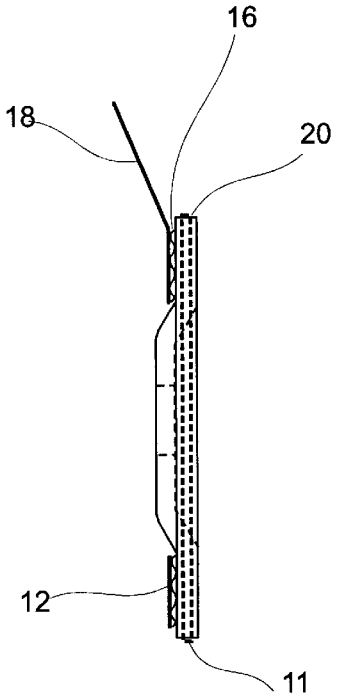
FIG. 5 is an side view of the present invention.

The second portion 18 is preferably configured as a tab which is of a sufficient size together with the first portion 12 to permit the printing of mentioned necessary information. The second portion 18 has an eyelet surface 24 extending therethrough for enabling hanging of the rotary cutting whee 11 on a display rack or the like when sold in a retail mode as seen in FIG. 2. Optionally, the second portion 18 may be folded over the first portion 12 as seen in FIG. 3 and the rotary cutting wheel 11 with its associated packaging material 10 may be stacked in a manner which readily permits bulk storage of the same.

By providing the present invention, there is a reduced amount of storage and/or display space required by the supplier/retailer of rotary cutting wheels. Additionally, the packaging substrate 10 of the present invention provides a dual purpose of enabling same stock of the rotary cutting wheel to be displayed in either a single item (retail) or multiple items (bulk) manner. Further, a reduction in the cost of production is achieved in that only one step of applying a substrate, blotter, to one side of the wheel 11 is required.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their fall scope including any such modifications, derivations and variations.

What is claimed is:

1. A packaging substrate configured for connection to a rotary cutting wheel, which includes:

a first portion thereof adhesively bonded to a side of the rotary cutting wheel; and a second portion integrally connected to said first portion of said packaging substrate and including a line of perforations separating said first portion and said second portion such that said second portion is detachable from the rotary cutting wheel and extending outwardly from the side of the rotary cutting wheel and said second portion further includes an eyelet surface therein to enable hanging of the rotary cutting wheel.

2. The packaging substrate of claim 1, wherein said package substrate is configured in a manner to permit said first portion and said second portion to be separated from one another in a manner to leave said first portion substantially in tact on the side of the rotary cutting wheel.

3. The packaging substrate of claim 1, wherein said packaging substrate has a printable surface formed thereon.

4. A packaging substrate configured connected to a rotary cutting wheel, which includes:

a rotary cutting wheel having two sides;

a first portion thereof adhesively bonded to a side of said rotary cutting wheel; and a second portion integrally connected to said first portion of said packaging substrate and including a line of perforations separating said first portion and said second portion such that said second portion is detachable from the rotary cutting wheel and extending outwardly from the side of the rotary cutting wheel and said second portion further includes an eyelet surface therein to enable hanging of said rotary cutting wheel.

5. The packaging substrate configured connected to a rotary cutting wheel of claim 4, wherein said package substrate is configured in a manner to permit said first portion and said second portion to be separated from one another in a manner to leave said first portion substantially in tact on said side of said rotary cutting wheel.

6. The packaging substrate configured connected to a rotary cutting wheel of claim 4, wherein said packaging substrate has a printable surface formed thereon.

* * * * *